US005600293A

United States Patent [19]

Hunter

[11] Patent Number: 5,600,293

[45] Date of Patent: Feb. 4, 1997

[54] INTEGRATED MAGNETIC EXPLODING FOIL INITIATOR FIRE SET

[75] Inventor: Donald Hunter, Silver Spring, Md.

[73] Assignee: The United States of America as represented by the Secretary of the Army, Washington, D.C.

[21] Appl. No.: 260,287

[22] Filed: Jun. 14, 1994

[51] Int. Cl.[6] ..... H05B 6/68

[52] U.S. Cl. ..... 336/182; 336/184; 336/186; 336/187; 336/189; 363/17; 123/143 B

[58] Field of Search ..... 336/182, 184, 336/186, 187, 189; 363/17; 123/143 B

[56] References Cited

U.S. PATENT DOCUMENTS

| | | | |
|---|---|---|---|
| 4,841,925 | 6/1989 | Ward | 123/143 B |
| 5,198,969 | 3/1993 | Redl et al. | 363/17 |

OTHER PUBLICATIONS

"A Proposed Safing and Arming Device for the FiberOptic guided Missile", by David D. Dell et al, Sandia Report printed Dec. 1988 for limited distribution.

"Baseline ESA Design and Technology Demonstration Flight Test", by Donald W. Hunter, Harry Diamond Laboratories Report printed Sep. 1992 for limited distribution.

*Primary Examiner*—Cassandra C. Spyrou
*Assistant Examiner*—G. R. Lord
*Attorney, Agent, or Firm*—Freda L. Krosnick; Frank J. Dynda

[57] ABSTRACT

An integrated magnetic exploding foil initiator fire set includes a DC-DC converter with a first transformer, a triggering mechanism with a second transformer, and an integrated magnetic structure for the respective transformers. Inductive interference is minimized in the respective transformers by the construction and placement of the transformer windings. The use of planar magnetic core material and flexprint or printed circuit technologies for the windings reduces the cost and weight of the structure and provides a compact construction. Thus, the triggering mechanism provides higher energy and voltage output and eliminate the need for expensive spark-gap switches.

27 Claims, 6 Drawing Sheets

INTEGRATED MAGNETIC EXPLODING FOIL INITIATOR FIRE SET

TECHNICAL FIELD

This invention is in the field of in-line, insensitive explosive fire sets which require a high-voltage DC-DC converter and high voltage trigger transformer.

BACKGROUND ART

To prevent the premature detonation of an explosive, an insensitive explosive munition is used in combination with an electronic safe and arm device. An electronic safe and arm device is nonfunctional until it is armed. Two independent environmental signatures must be detected to actuate the electronic safe and arm device. For example, these signatures could be fin deployment and launch acceleration in the case of a missile, or firing setback and spin in the case of an artillery projectile.

An exploding foil initiator (EFI) is the basis of an electronic safe and arm device. The EFI consists of copper and kapton in a necked-down bridge form which is vaporized. An accelerating bullet of molten copper and kapton passes through a hole in a piece of plastic or sapphire and impacts on an insensitive type explosive. The insensitive type explosive is detonated by the shock of the impact of the copper-kapton bullet.

A conventional fire set for detonating an insensitive type explosive consists of (1) a DC-DC converter including a first transformer and a capacitor and (2) a trigger circuit including a second transformer. Arming of the fire set occurs when the capacitor is charged to a high level and firing occurs when the capacitor discharges into the foil. The DC-DC converter charges the capacitor and the separate trigger circuit causes the capacitor to discharge into the foil.

The transformers used in conventional exploding foil initiator (EFI) and exploding bridge wire (EBW) fire sets are expensive and relatively large components. Thus, a need exists in the fire set art for compact, light, and cheap transformer components.

SUMMARY OF THE INVENTION

These and other disadvantages of the prior art have been overcome by the apparatus of the present invention. In the present invention, an integrated magnetic structure has been incorporated into an exploding foil initiator fire set.

The integrated magnetic structure includes a first transformer with a first and a second winding, a second transformer with a third and a fourth winding, and a core element with a center pole and two outer poles, such that the first and second windings are positioned on the center pole and the third and fourth windings are each split and positioned with half on each of the outer poles, so that inductive interference between the first and second transformers is minimized.

The first flux generated by the first winding, and coupled to the second winding, induces equal and opposite voltages in the third and fourth windings respectively. A second flux generated by the third winding, and coupled to the fourth winding, cancel in the center pole.

The second winding and the fourth winding are configured to minimize capacitance. Capacitance loads the windings and creates losses. The second and fourth windings, respectively, are on both sides of respective insulating layers so that a track on one side is over a space on the other side. The first and third windings, respectively, are on both sides of respective insulating layers so that a track on one side is over a track on the other side to reduce the conductive cross-section seen by the second and fourth windings. The spaces are wider than the tracks.

The core element is a planar magnetic device. The first, second, third, and fourth windings are flexprint or printed circuit windings.

An integrated magnetic exploding foil initiator fire set system, in accordance with the present invention, includes a DC-DC converter with a first transformer, a trigger circuit with a second transformer, and an integrated magnetic structure of the first transformer and the second transformer, so that the inductive interference between the first transformer and the second transformer is minimized. As noted above, the first transformer includes a first winding and a second winding, the second transformer includes a third winding and a fourth winding, and the system further includes a core element with a center pole, a first outer pole, and a second outer pole. The first winding and said second winding are positioned on the center pole, and the third winding and the fourth winding are each split and positioned with half on the first outer pole and half on the second outer pole.

The first flux generated by the first winding of the inventive fire set system, and coupled to the second winding, induces equal and opposite voltages in the third and fourth windings, respectively. The second flux generated by the third winding, and coupled to the fourth winding, cancels in the center pole.

The second winding and the fourth winding of the inventive fire set system are configured to minimize capacitance. The second and the fourth windings, respectively, are on both sides of respective insulating layers so that a track on one side is over a space on the other side. The first and third windings, respectively, are on both sides of respective insulating layers so that a track on one side is over a track on the other side to reduce the conductive cross-section seen by the second and fourth windings. The spaces between tracks are wider than the tracks.

The core element of the inventive fire set system is a planar magnetic device. The first, second, third, and fourth windings are flexprint or printed circuit windings.

The DC-DC converter includes a first switching transistor connected in series with the first winding and a first capacitor connected in parallel with the second winding. The trigger circuit includes a second switching transistor connected in series with the third winding and a second capacitor connected in parallel with the third winding. A spark-gap switch, with a triggering element coupled to the fourth winding, is connected to the first capacitor and an exploding foil initiator.

Thus, the integrated magnetic structure reduces the cost of the transformers, reduces the weight of the structure, and provides for a compact construction. The inventive device eliminates the need for a second separate transformer. The use of such an integrated magnetic structure allows the trigger circuit to provide higher energy and voltage than typical trigger transformers. This permits the use of a low-cost initiating switch instead of expensive, hermetically sealed spark-gap switch structures. Since the trigger circuit transformer is combined with the DC-DC converter transformer, a more robust device is created.

The above and other features of the invention, including various novel details of construction and combinations of parts, will now be particularly described with reference to the accompanying drawings and pointed out in the claims. It will be understood that the particular device embodying the invention is shown by way of illustration only and not as a limitation of the invention. The principles and features of this invention will be employed in varied and numerous embodiments without departing from the scope of the invention.

DETAILED DESCRIPTION OF THE INVENTION

Figure 1:
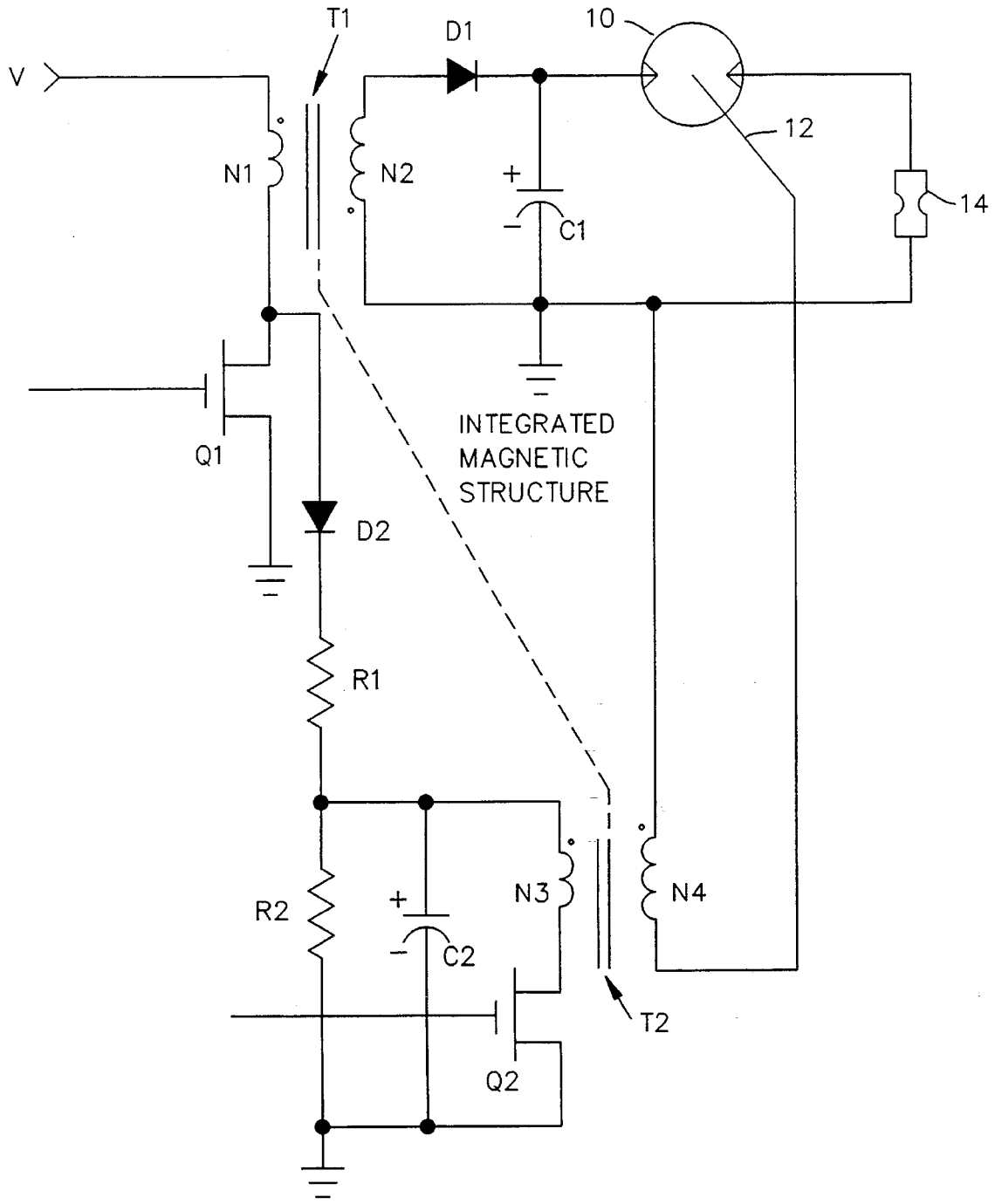
FIG. 1 is a schematic diagram of an EFI fire set of the present invention with an integrated magnetic assembly.

Now turning to the preferred embodiment, FIG. 1 illustrates an integrated magnetic EFI fire set in accordance with the present invention. The device includes a DC-DC converter consisting of a first transformer T1 with a first winding N1 and a second winding N2, a first diode D1, a first capacitor C1 coupled to the second winding, and a first switching transistor Q1 which is connected in series with the first winding. Arming of the device occurs when power is present on lead V and a periodic signal is present on the gate of first switching transistor Q1. As shown, the device operates as a flyback DC-DC converter. When first switching transistor Q1 is turned on, a current flows through the first winding N1 of the first transformer T1 and energy is stored in the magnetic structure. When the first switching transistor Q1 is turned off, energy is transferred to the first capacitor C1 through the first diode D1. The operation of the DC-DC converter continues until the first capacitor C1 charges to an appropriate voltage level. Coincident with the charging of the first capacitor C1, a second capacitor C2 is charged. When the first switching transistor Q1 turns off, energy is transferred to the second capacitor C2 through a second diode D2 which is coupled to the first winding. Resistor R1 limits the peak current from the second diode D2 and forms a voltage divider with resistor R2. Resistors R1 also bleeds charge from capacitor C2. Typically, the voltage on capacitor C1 is 2.5 to 3.0 KV and the voltage on capacitor C2 is 100 to 200 volts. Arming continues until capacitors C1 and C2 are charged.

Firing occurs through the use of the trigger circuit which includes a second switching transistor Q2, transformer T2 with a third winding N3 and a fourth winding N4, and spark-gap switch 10 with trigger electrode 12. When a pulse is present on the gate of second switching transistor Q2, it conducts and the energy stored in the second capacitor C2 is discharged into the third winding N3 and transferred to the fourth winding N4. This causes a high-energy pulse to appear on the trigger electrode 12 of the spark-gap switch 10. Thus, the exploding foil initiator 14 is vaporized and an explosion is initiated. The D.C.-D.C. converter and the trigger circuit never operate simultaneously because of the prescribed gating of the first and second switching transistors. This produces a compatibility that allows the first and second transformers to be part of the same integrated magnetic structure.

It should be noted that the respective polarities of coils N1, N2 must be opposite to one another to maintain the flyback operation of the DC-DC converter. However, the polarities of windings N3 and N4 are determined by the specific triggering requirements of the switch used.

A flyback DC-DC converter is shown by way of example. Any type of DC-DC converter can be used. For example, a resonant mode converter, a push-pull forward acting converter, or any converter using a voltage multiplier can be substituted for the DC-DC converter shown in FIG. 1. Thus, any equivalent converter structure could be substituted in the inventive device.

As will be shown in the discussion of FIGS. 2 to 6, the integrated magnetic structure of first transformer T1 with windings N1, N2, and second transformer T2 with windings N3, N4 operate as separate, independent devices. As noted above, compatibility results because of the voltage and power levels in the respective transformers and the timing of the gating of the first and second switching transistors so that the D.C.-D.C. converter and the triggering circuit never operate simultaneously.

Figure 2:
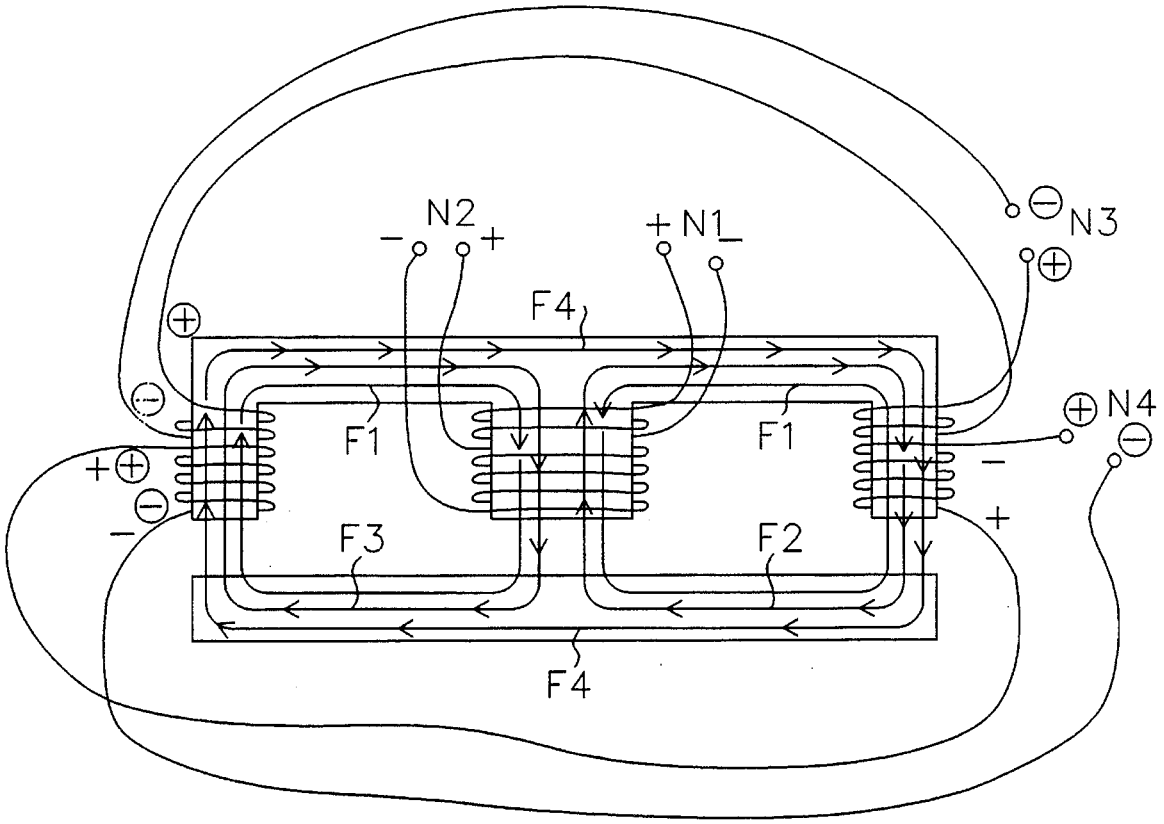
FIG. 2 illustrates the placement of transformer windings in the present invention and the resulting flux generated.

As shown in FIG. 2, the respective transformers of the present invention are inductively independent of one another. FIG. 2 shows the flux paths and windings of the integrated magnetic structure. First winding N1 and second winding N2 of the first transformer T1 of the DC-DC converter are placed on the center pole of an E-shaped core element 16. Third winding N3 and fourth winding N4 of the second transformer T2 of the trigger circuit are split and are positioned on the outer poles of the E-shaped core element 16. An I-shaped element 18 completes the magnetic circuit.

In operation, the current in the first winding N1 (and the second winding N2, if present) causes magnetic flux to circulate down the center pole and up the outer poles, as shown by arrow f1. Third winding N3 and fourth winding N4 are split and connected with their polarities such that the current in windings N1 and N2 cause equal and opposite voltages to be induced in each half of windings N3 and N4, so that the voltages are nulled or canceled. Ideally, windings N3 and N4 do not respond to the center pole flux of windings N1 and N2. The center pole and outer poles can have any desired air gap or no gap depending upon the type of transformers used as will be described in the later discussion of FIG. 5.

As noted previously, triggering occurs when the voltage and energy in capacitor C2 is transferred to winding N3. Current in winding N3 forms flux around the outer poles, but the flux cancels in the center pole as shown by arrows f2 and f3 such that no voltage is induced in windings N1 and N2. The sum of flux f2 and f3 in the outer poles couples to winding N4 and is shown by arrow f4.

In summary, the action of the first transformer T1, consisting of windings N1 and N2, nulls voltages in windings N3 and N4 of transformer T2. The respective winding polarities in windings N3 and N4 nulls the center pole flux and avoids interaction with windings N1 and N2 of transformer T1. The flux from split windings N3 and N4 cancel in the center pole and no voltage is generated in windings N1 and N2. Thus, the respective transformers operate in a separate and independent fashion.

Figure 5:
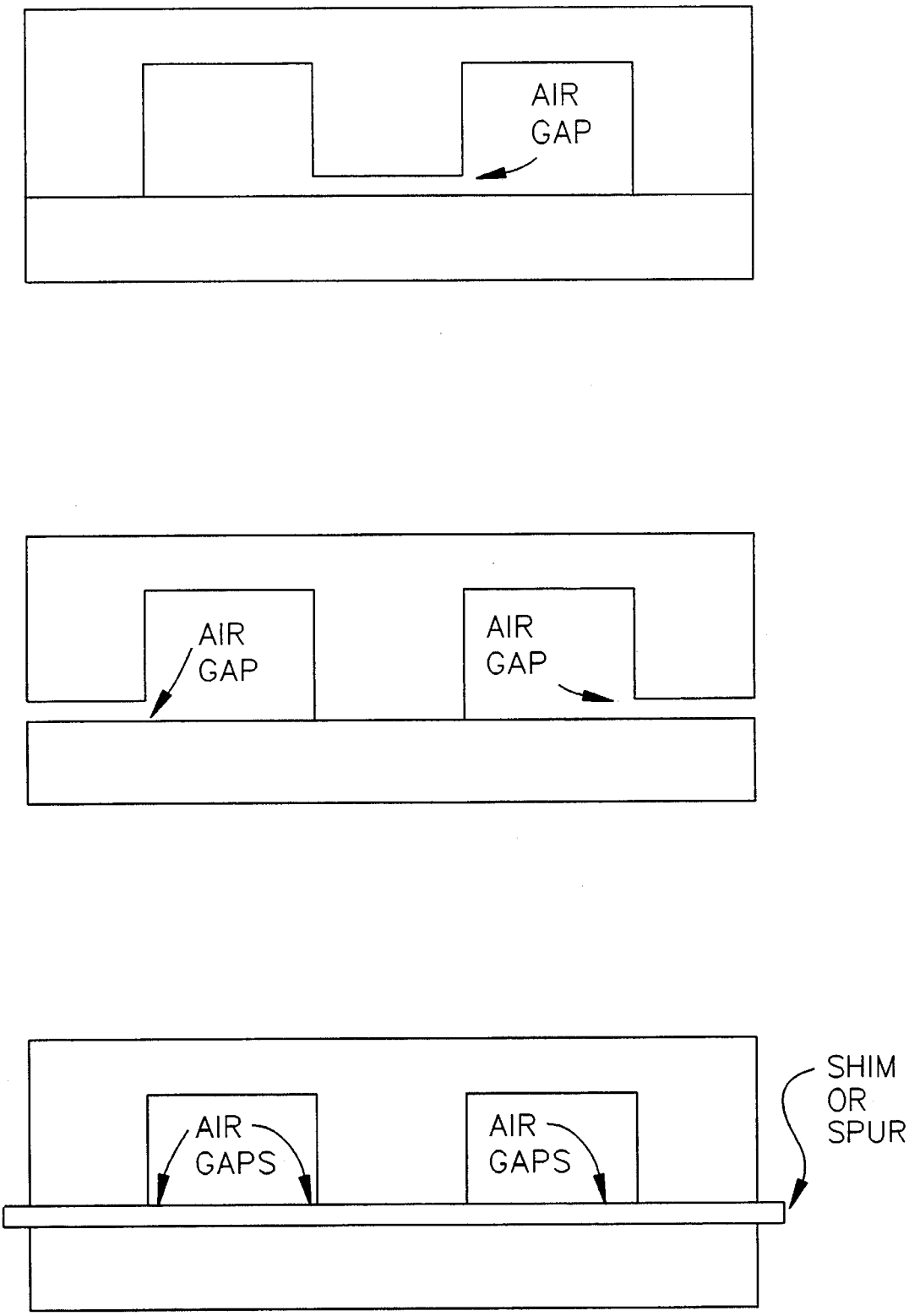
FIG. 5 illustrates several air gap constructions in the core element of the present invention.

As shown in FIG. 5, different air gaps or no air gap can be used. An E-shaped element core element 48 with the required air gaps can be used depending on the requirements of transformers T1 and T2 with an I-shaped element 46. In the preferred embodiment of the core element, ferrites are used. However, other compositions can also be used. Also, it should be noted that in the preferred embodiment printed circuit techniques are used for the winding. However, conventional bobbin and wire techniques can also be utilized.

Thus, the two transformers on a single core are very compatible because the flux is canceled and the wiring is split. There is essentially no interaction between the respective transformers.

The present invention is easily adapted to any evolution in switch technology. For example, a dielectric breakdown switch, using an embedded electrode, can also be used. Such a dielectric breakdown switch is of low-cost and small size as compared to the spark-gap switch. The relatively high trigger energy and voltage levels that can be achieved with the present invention permit the use of such dielectric breakdown switches.

FIGS. 3A, 3B, 4A, and 4B illustrate the construction of transformer windings in accordance with the present invention to minimize capacitance.

Figure 3A:
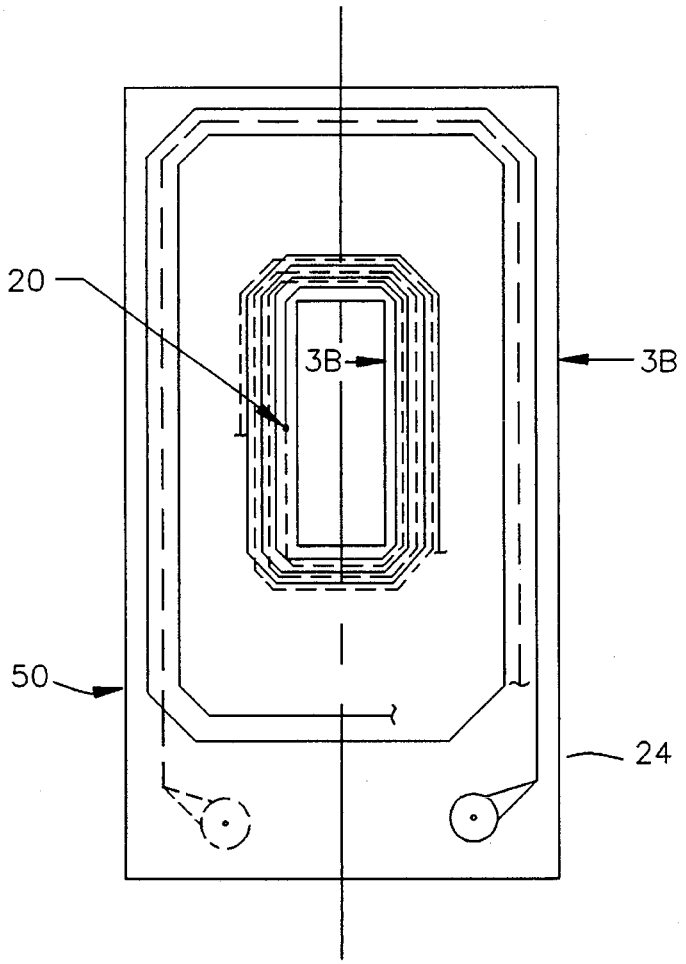
FIGS. 3A and 3B illustrate the construction of the transformer secondary winding according to the present invention which minimizes capacitance.
Figure 3B:
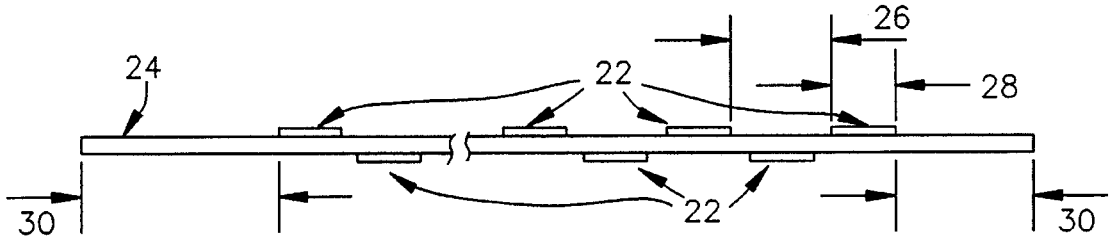

The performance of the integrated magnetic structure of the present invention is enhanced by controlling the winding capacitance. As shown in FIGS. 3A and 3B, by staggering the placement of the winding tracks 22 on opposite sides of a dielectric layer 24, the winding capacitance of a flexible printed circuit 50 for secondary transformer windings can be reduced. Such a technique is preferred for the secondary windings N2 and N4 of respective transformers. For example, winding tracks 22 can have a width 28 which is narrower than the space 26 between tracks. Spacing 30 illustrates the distance between the end of the dielectric layer 24 and the closest track 22. Via 20 connects tracks on opposite sides of the dielectric layer.

Figure 4A:
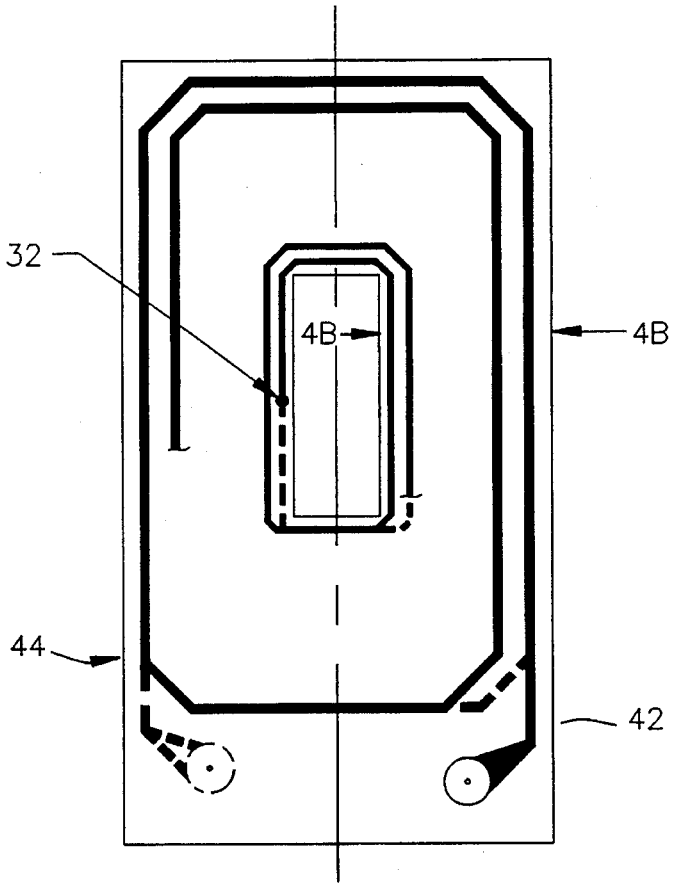
FIGS. 4A and 4B illustrate the construction of the transformer primary winding according to the present invention which minimizes the conductive cross-section seen by the transformer secondary winding.
Figure 4B:
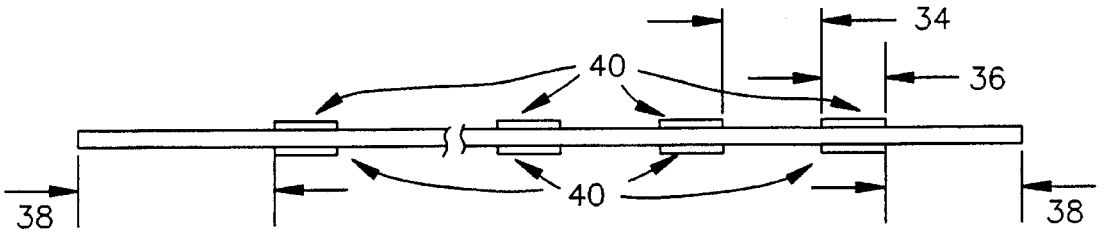

Also, as shown in FIGS. 4A and 4B, the primary windings N1 and N3 of the respective transformers can be constructed on a flexible printed circuit 44 for primary transformer windings to minimize the conductive cross-section seen by the secondary windings N2 and N4 of the respective transformers. This is accomplished by placing the tracks 40 of the windings on top of each other on both sides of dielectric layer 42 and also by providing a wide space 34 between the turns. The space 34 between tracks is wider than the width 36 of track 40. Spacing 38 illustrates the distance between the end of the dielectric layer 42 and the closest track 40. Via 32 connects tracks on opposite sides of the dielectric layer.

A coil on flexprint, i.e., flexible printed circuit, has the appeal of a dielectric flexprint, i.e., a high dielectric strength compared to the low dielectric strength of fiberglass (typically 3 KV. per mil vs. 500 V. per mil). Thus, such a flexprint assembly can be much thinner than one composed of fiberglass.

Figure 6:
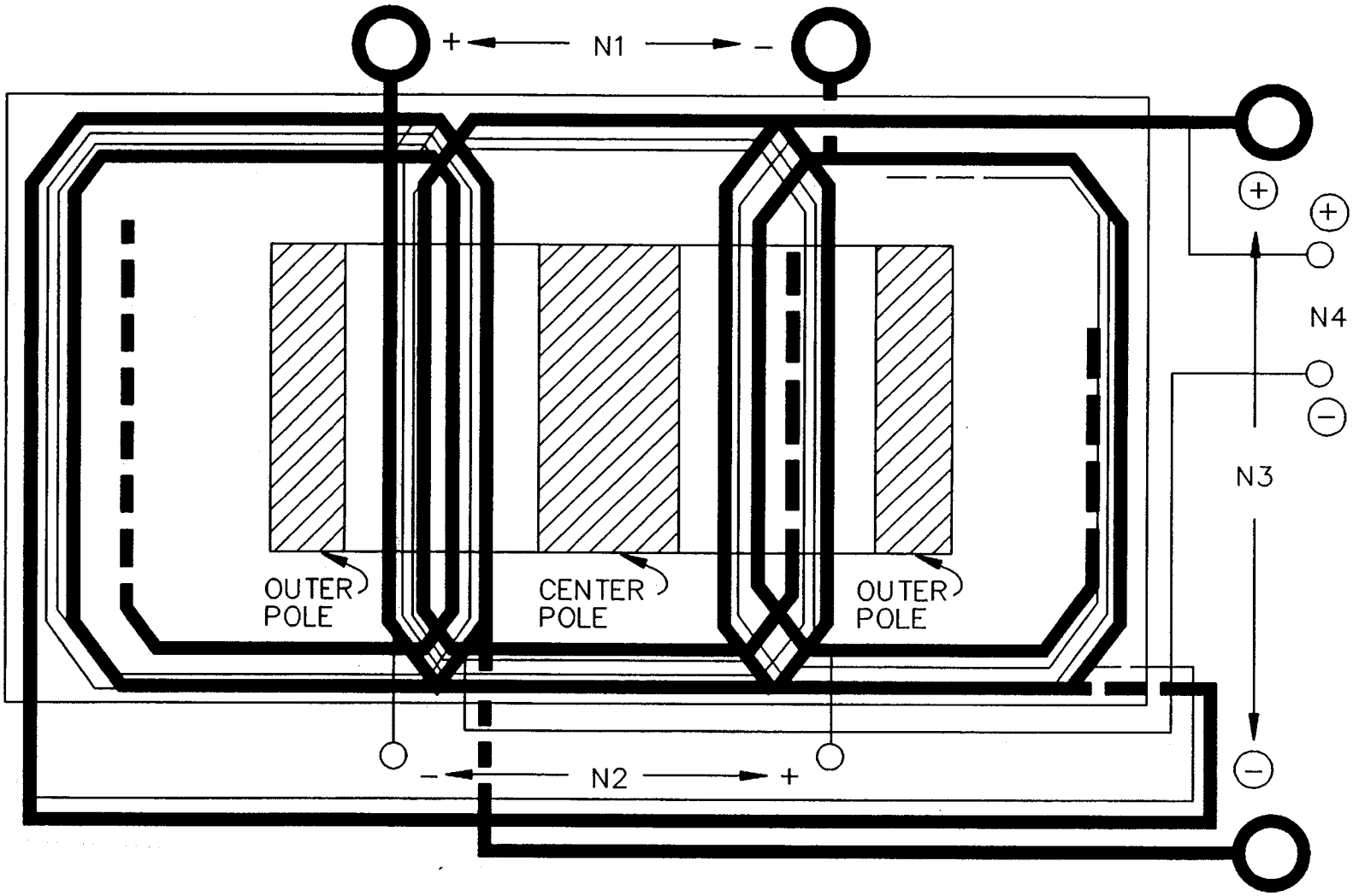
FIG. 6 illustrates the construction of the integrated magnetic structure of the present invention with the windings N1–N4 placed on the center and outer poles.

FIG. 6 illustrates the construction of the integrated magnetic structure of the present invention. Flexprint windings N1 and N2 of the first transformer of the DC-DC converter are placed upon the center pole of the planar core element. Flexprint split winding N3 and N4 of the second transformer of the triggering circuit are placed on the outer poles of the planar core element.

Thus, the following advantages of using an integrated magnetic device for this application are achieved. The two transformers never have to operate simultaneously. The DC-DC converter transformer operates only during charging of the energy storage capacitor and the trigger transformer operates only during firing. Design complexities from asymmetrical amounts of magnetic flux in the outer poles are avoided. The isolation requirement for the two transformers is modest. The trigger transformer benefits from the large core of the DC-DC converter transformer. Accordingly, inductive and capacitive interference between the respective transformer is avoided. A cheap, light, and compact device is developed. Finally, in view of the high voltage developed by the present invention, cheaper trigger switch mechanisms can also be used instead of the standard spark-gap switch.

Those skilled in the art will recognize, or be able to ascertain, using no more than routine experimentation, many equivalents to the embodiments of the invention described herein.

These and all other equivalents are intended to be encompassed by the following claims.

I claim:

1. An integrated magnetic structure comprising:

a first transformer including a first winding and a second winding, a second transformer including a third winding and a fourth winding, and a core element including a center pole, a first outer pole, and a second outer pole, wherein said first winding and said second windings are positioned on said center pole, and said third winding and said fourth winding are positioned on said first outer pole and said second outer pole, so that inductive interference between said first transformer and said second transformer is minimized.

2. The structure of claim 1, wherein a first flux generated by said first winding induces equal and opposite voltages in said third winding and said fourth winding, respectively.

3. The structure of claim 1, wherein a second flux generated by said third winding cancels in said center pole.

4. The structure of claim 1, wherein said second winding and said fourth winding are configured to minimize capacitance.

5. The structure of claim 4, wherein said second winding is on a first insulating layer with a first side and second side and said second winding is positioned on both sides of said first insulating layer so that a track on said first side is over a space on said second side.

6. The structure of claim 4, wherein said fourth winding is on a second layer with a first side and a second side and said fourth winding is positioned on both sides of said second insulating layer so that a track on said first side is over a space on said second side.

7. The structure of claim 4, wherein said first winding is on a third insulating layer with a first side and a second side and said first winding is positioned on both sides of said third insulating layer so that a track on said first side is over a track on said second side to reduce a conductive cross-section seen by said second and fourth windings.

8. The structure of claim 7, wherein spaces between adjacent tracks are wider than said tracks.

9. The structure of claim 4, wherein said third winding is on a fourth insulating layer with a first side and a second side and said third winding is positioned on both sides of said fourth insulating layer so that a track on said first side is over a track on said second side to reduce a conductive cross-section seen by said second and fourth windings.

10. The structure of claim 9, wherein spaces between adjacent tracks are wider than said tracks.

11. The structure of claim 1, wherein said core element is a planar magnetic device.

12. The structure of claim 1, wherein said first, second, third, and fourth windings are flexprint or printed circuit windings.

13. An integrated magnetic exploding foil initiator fire set system comprising:

a DC-DC converter including a first transformer, a trigger circuit including a second transformer, and an integrated magnetic structure including said first transformer so that inductive interference between said first transformer and said second transformer is minimized, and, wherein said first transformer includes a first winding and a second winding, said second transformer includes a third winding and a fourth winding, and further comprising: a core element including a center pole, a first outer pole, and a second outer pole, said first winding and said second winding are positioned on said center pole, and said third winding and said fourth winding are positioned on said first outer pole and said second outer pole.

14. The system of claim 13, wherein a first flux generated by said first winding induces equal and opposite voltages in said third winding and said fourth winding, respectively.

15. The system of claim 13, wherein a second flux generated by said third winding cancels in said center pole.

16. The system of claim 13, wherein said second winding and said fourth winding are configured to minimize capacitance.

17. The system of claim 16, wherein said second winding is on a first insulating layer with a first side and a second side and said second winding is positioned on both sides of said first insulating layer so that a track on said first side is over a space on said second side.

18. The system of claim 16, wherein said fourth winding is on a second insulating layer with a first side and a second side and said fourth winding is positioned on both sides of said second insulating layer so that a track on said first side is over a space on said second side.

19. The system of claim 16, wherein said first winding is on a third insulating layer with a first side and a second side and said first winding is positioned on both sides of said third insulating layer so that a track on said first side is over a track on said second side to reduce a conductive cross-section seen by said second and fourth windings.

20. The system of claim 19, wherein spaces between adjacent tracks are wider than said tracks.

21. The system of claim 16, wherein said third winding is on a fourth insulating layer with a first side and second side and said third winding is positioned on both sides of said fourth insulating layer so that a track on said first side is over a track on said second side to reduce a conductive cross-section seen by said second and fourth windings.

22. The system of claim 21, wherein spaces between adjacent tracks are wider than said tracks.

23. The system of claim 13, wherein said core element is a planar magnetic device.

24. The system of claim 13, wherein said first, second, third, and fourth windings are flexprint or printed circuit windings.

25. The system of claim 13, wherein said DC-DC converter further comprises:

a first switching transistor coupled in series with said first winding, and a first capacitor coupled in parallel with said second winding.

26. The system of claim 25, wherein said trigger circuit further comprises:

a second switching transistor coupled in series with said third winding, and a second capacitor coupled in parallel with said third winding.

27. The system of claim 26, further comprising:

a spark-gap switch with a triggering element, said spark-gap switch coupled to said first capacitor and said triggering element coupled to said fourth winding, and an exploding foil initiator coupled to said spark-gap switch and said first capacitor.

* * * * *